US009578909B2

(12) United States Patent
Daniels

(10) Patent No.: US 9,578,909 B2
(45) Date of Patent: Feb. 28, 2017

(54) JACKET GARMENT FOR TANDEM VEHICLE PASSENGER SAFETY

(71) Applicant: Christopher Daniels, Renton, WA (US)

(72) Inventor: Christopher Daniels, Renton, WA (US)

( * ) Notice: Subject to any disclaimer, the term of this patent is extended or adjusted under 35 U.S.C. 154(b) by 20 days.

(21) Appl. No.: 14/261,424

(22) Filed: Apr. 25, 2014

(65) Prior Publication Data

US 2015/0305420 A1 Oct. 29, 2015

(51) Int. Cl.

| | |
|---|---|
| ***A41D 27/20*** | (2006.01) |
| ***A41D 1/02*** | (2006.01) |
| ***A41D 27/02*** | (2006.01) |
| ***A41D 13/00*** | (2006.01) |
| *A41F 9/00* | (2006.01) |

(52) U.S. Cl.

CPC ..... *A41D 27/20* (2013.01); *A41D 1/02* (2013.01); *A41D 13/0007* (2013.01); *A41D 27/02* (2013.01); *A41F 9/005* (2013.01)

(58) Field of Classification Search

CPC ..... A41D 13/00; A41D 2400/82; A41D 2600/102; A41D 27/02; A41D 27/20

See application file for complete search history.

(56) References Cited

U.S. PATENT DOCUMENTS

| | | | | |
|---|---|---|---|---|
| D361,115 | S * | 8/1995 | Lucius | D2/829 |
| D426,937 | S * | 6/2000 | Auster | D2/829 |
| D641,960 | S * | 7/2011 | Goff | D2/829 |
| D686,391 | S * | 7/2013 | Beber | D2/829 |
| 2004/0250332 | A1* | 12/2004 | Tadin | A41D 13/0007 2/94 |
| 2009/0172860 | A1* | 7/2009 | Tomlinson | A41D 3/00 2/85 |
| 2009/0172861 | A1* | 7/2009 | Tomlinson | A41D 3/00 2/85 |
| 2013/0047314 | A1* | 2/2013 | Alvarado, Jr. | A41D 13/00 2/93 |

* cited by examiner

*Primary Examiner* — Anna Kinsaul

(74) *Attorney, Agent, or Firm* — Patent Ingenius LLC; Scott Evan Gilbert

(57) ABSTRACT

A novel jacket garment worn by the driver of a tandem vehicle, such as a motorcycle, intended for rear passenger safety is disclosed. The novel garment comprises an outer shell, an inner lining, and an internal frame structure. The internal frame structure comprises a ribbing nexus comprising horizontal and vertical members. Novel features include handgrips disposed inside front pockets and connected to the internal frame structure. In some embodiments, the internal frame structure comprises elastic members. Pocket-borne handgrips may be attached to elastic members so that when engaged by a rear tandem passenger, the internal frame structure is tightened against the tandem vehicle driver's body to provide stain relief and additional stabilization of the jacket as a passenger safety device.

18 Claims, 6 Drawing Sheets

JACKET GARMENT FOR TANDEM VEHICLE PASSENGER SAFETY

FIELD OF THE INVENTION

This invention relates to tandem vehicle passenger safety garments, particularly jackets worn by the driver of the tandem vehicle.

BACKGROUND

Safety for rear passengers of motorcycles and other tandem-rider vehicles such as snowmobiles, is best served if the rear passenger can grasp handles or handgrips provided on a specially designed harnesses or a garments, such as motorcycle safety jackets, worn by the driver of the vehicle.

SUMMARY OF THE INVENTION

The invention is a jacket garment providing a plurality of exposed and covered handgrips for access by a rear passenger of a two-seat vehicle, such as a motorcycle or snowmobile. The inventive jacket garment comprises a lining, an outer shell and an internal frame comprising a network of stress-relieving structural members, henceforth referred to as ribbing. The internal frame generally disposed between the inner lining and outer shell of the inventive jacket garment, and comprises a plurality of flexible members. Some of said ribbing members may also be elastic. The inventive jacket garment further comprises a plurality of handgrips disposed on different panels of the jacket shell. The internal frame ribbing nexus is provided to distribute forces away from the points of greatest stresses on the jacket garment when a motorcycle passenger grasps and pulls on any of the plurality of handgrips in order to gain stability when the vehicle accelerates straight ahead or in turns or curves.

In the preferred embodiment of the inventive jacket garment, at least two of the handgrips are contained within two handgrip pockets disposed on lower portions of each of the two front panels of the inventive jacket, whereby the pocket-borne handgrips provide for passenger comfort as well as safety, as they provide protection of the hands of the rear passenger against exposure to fast-moving air, cold and inclement weather conditions. The handgrip pockets comprise an interior cavity, and a handgrip disposed within the interior cavity of each handgrip pocket. A passenger riding behind the driver of the two-seat vehicle may grip the pocket-borne handgrips by wrapping arms around the driver, and placing hands in the interior cavity of the handgrip pockets to grasp the handgrips within.

In one set of embodiments, the plurality of handgrips may be integrally affixed to structural members of the garment's internal frame. As an example, handgrips may comprise straps having two ends. Both exposed and pocket-borne handgrips may be affixed to ribbing members of the internal frame by attachment of the ends of the handgrips to the ribbing members. By way of example, handgrips may have ends inserted through holes or slits in the jacket shell to access the space between the shell and interior lining of the inventive jacket garment to be attached to the ribbing nexus at strategic points. Methods of attaching handgrips to the ribbing include, but are no means limited to, stitching, such as standard commercial stitching, ultrasonic welding, grommeting, riveting, and gluing by adhesives known in the art, such as fabric and plastic adhesives. Handgrip ends may also be sewn to the internal frame ribbing by stitching through the shell of the jacket so that the integrity of the jacket shell is not compromised.

According to the invention, all embodiments of the internal frame comprise a non-elastic, but flexible, ribbing nexus, and a subset of these embodiments may comprise structural members that are elastic, and which may be tied to the non-elastic structural members ribbing nexus. In the latter set of embodiments, pocket-borne handgrips may be tied to the internal frame via an elastic tie or band, wherein the elastic tie or band is connected to the internal frame.

In a particular embodiment, the internal frame comprises a single elastic waistband divided into two segments, as well as elastic shoulder straps attached to the elastic waistband at points in the front and rear panels of the inventive jacket garment. The internal frame may comprise a non-elastic rear vertical spine to which both segments of the waistband are attached, and from which tresses extend to attach to the shoulder straps. A non-elastic collar ribbing may also be provided for attachment points for the shoulder straps as well. Pocket-borne handgrips may be attached to the single waistband member only, or two both the waistband member and to the shoulder strap members, by an extension of the internal frame connecting the pocket-borne handgrips to the waistband member and shoulder strap members of the internal frame.

In the exemplary embodiment, the vehicle passenger pulls on the pocket-borne handgrips, causing the waistband frame member to tighten about the waist of driver. This action simultaneously pulls on front portion of shoulder straps, the elastic material pulling downward, tightening front portion of jacket over front torso. The rear segments of shoulder straps being attached to the waistband, will draw tight as well. Shoulder straps may be anchored on the collar ribbing for additional support. This embodiment provides for increased support and distribution of forces imparted to the inventive jacket garment through the pocket-borne handgrips when the rear passenger In another embodiment example, the inventive jacket comprises a plurality of external handgrips and front pocket-borne handgrips. The pocket-borne handgrips may comprise two ends, each end attached to a structural member of the internal frame for support and distribution of force. By way of example, the internal frame comprises two elastic waistband members encircling the hem of the jacket, the first waistband being disposed vertically above the second waistband. As in the previous example, the elastic waistband members may comprise two segments, each segment having two ends. One end of each segment is affixed to a non-elastic spine member of the internal frame, and the opposing ends of each segment are affixed frame members disposed along the edges of the two front panels of the inventive jacket, for example, along the front zipper. Preferably, other elastic members of the harness nexus, each having a first end and a second end, may have a first end affixed to an anchor point on a non-elastic harness skeleton member, and a second end affixed to a second anchor point disposed along the elastic waistband member. In the instant example, the pocket-borne handgrips may comprise straps having two ends. In addition, each handgrip may be oriented substantially vertically so that the handgrips comprise an upper end and a lower end. Each handgrip may then be affixed to both of the elastic waistband members, wherein the upper end of each handgrip is affixed to the upper waistband and the lower end affixed to the lower waistband.

In the instant example, the innovative internal frame provides for enhanced structural support and force dispersion when the rear passenger pulls on the pocket handgrips. Tensile forces are transmitted from the handgrips to the elastic waistband members, and the waist of the jacket may then be tightened around the lower torso of the driver. Simultaneously, tensile forces may be applied to the secondary elastic members that tend to distribute, or disperse tensile forces substantially equally at different anchor points on the non-elastic skeleton members around the structure of the internal frame. As tensile forces are transmitted to the non-elastic ribbing of the innovative jacket internal frame, the ribbing members may be tightened against the torso of the driver. The elastic members may distribute the tension on the ribbing members of the internal frame so that the tensile forces due to the passenger pulling on the pocket-borne handgrips are not focused in any particular location, a situation that may potentially result in failure of the harness structure, or tearing the stitching of the jacket shell or lining. Moreover, the tension on the harness ribbing stiffens the harness structure by pulling it against the driver's torso, providing additional structural support.

The external (exposed) handgrips may also be attached to the internal frame in ways similar to the pocket-borne handgrips. For instance, external handgrips may comprise straps having first and second ends. The first and second ends of the handgrips may access the internal frame through slits or holes made in the innovative jacket shell and penetrate the space between the shell and lining. Alternatively, handgrip ends may be attached to the internal frame members without accessing the internal frame directly, by methods known in the art such as, but not limited to: stitching, grommeting, riveting, welding and gluing.

The inventive safety jacket may closed when worn by the driver by zipping or buttoning the two front panels In the event the motorcycle driver does not close the front panels of the jacket using the front zipper, buttons, or other means of at least partially closing the two front panels, thereby holding the front panels of the inventive jacket relatively stationary while the rear passenger grasps and pulls on the external or pocket-borne handgrips. In the event the driver chooses not to close the jacket by use of the front zipper or buttons, the inventive safety jacket further comprises one or more clasps or buckled straps in the front portion of the jacket to at least partially hold the front jacket panels from opening when the rear passenger pulls on the pocket handgrips.

DETAILED DESCRIPTION

Figure 1:
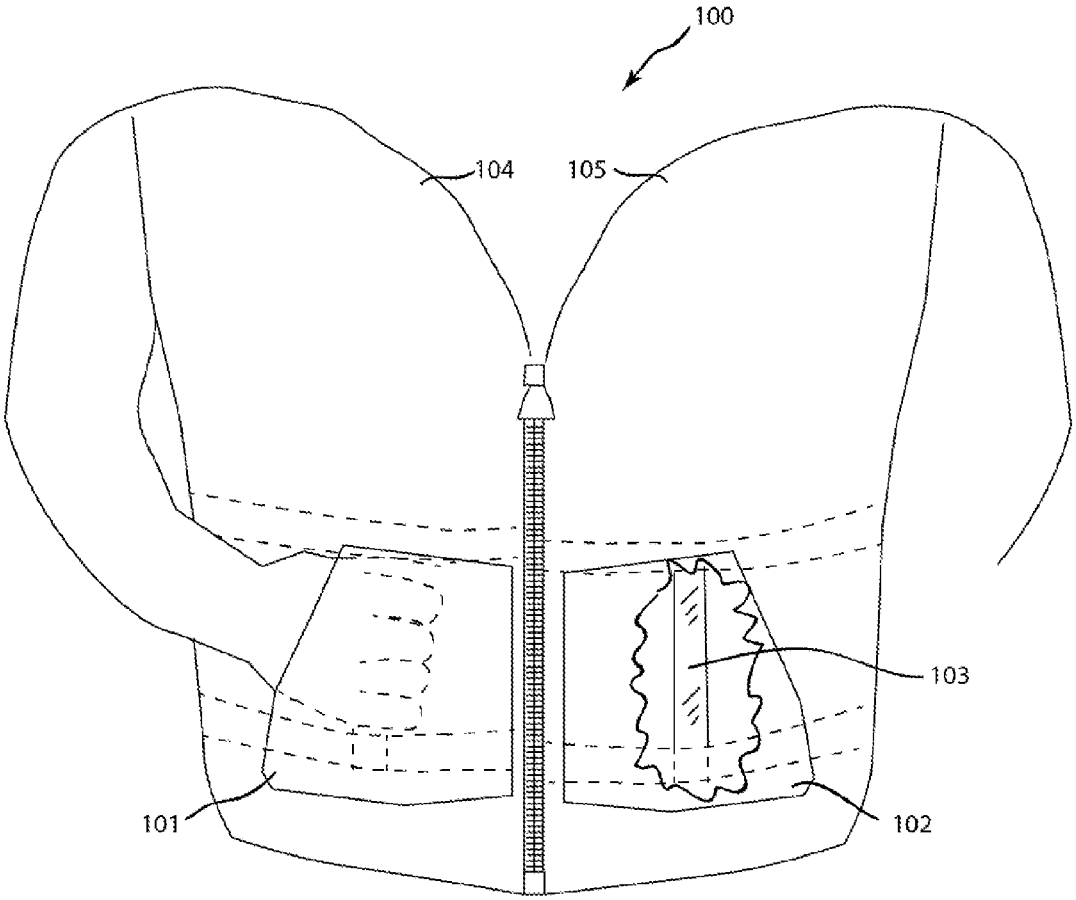
FIG. 1. Frontal view of the preferred embodiment of the inventive safety jacket.

FIG. 1 shows a partial frontal view of the preferred embodiment of the inventive safety jacket 100, emphasizing the novel front passenger safety pockets 101 and 102, and the pocket-borne handgrips 103 for tandem passenger safety contained within the cavity or front passenger safety pockets 101 and 102 shown in transparent view for pocket 102. The inventive jacket comprises left front panel 104 and right front panel 105.

Figure 2:
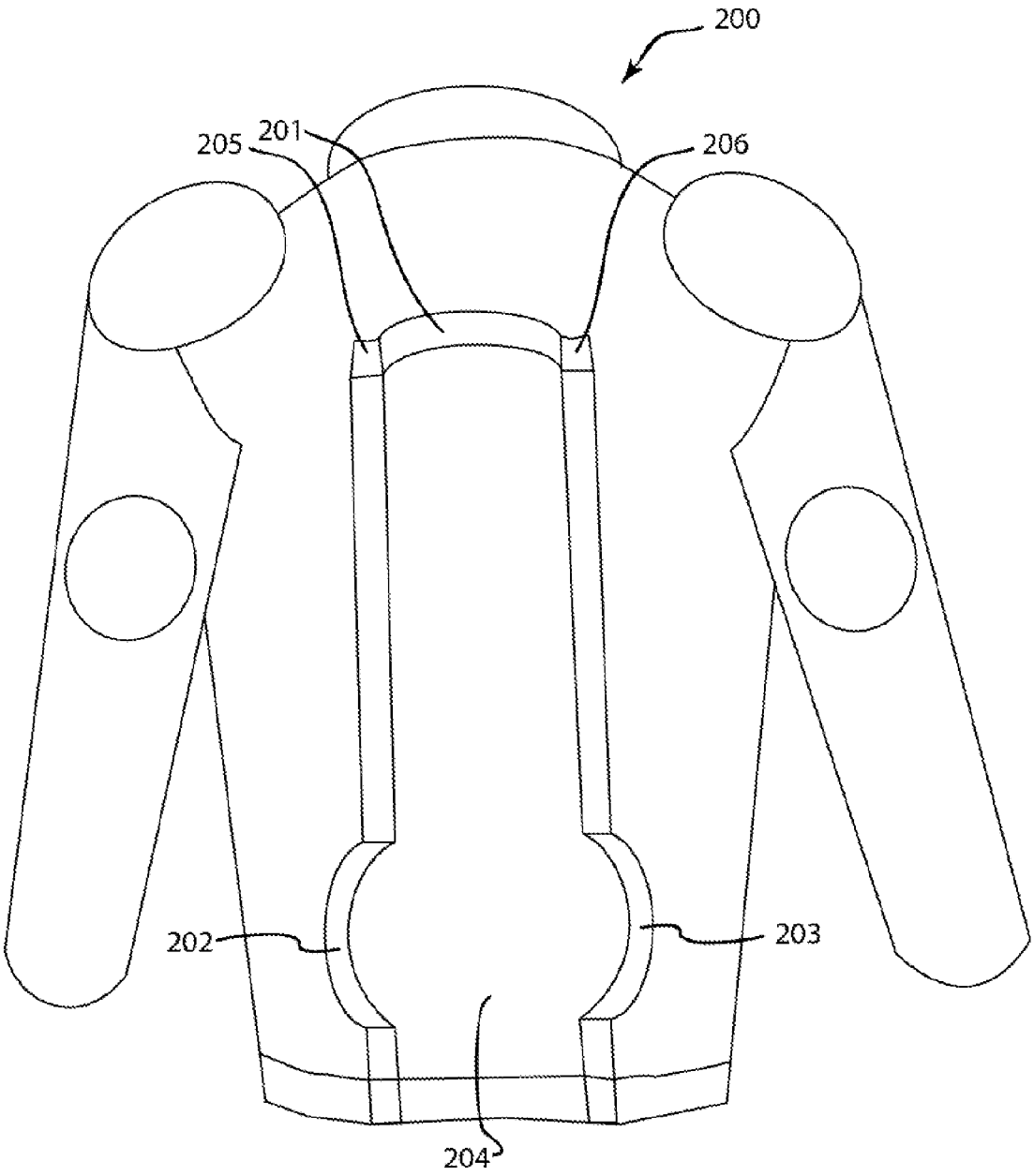
FIG. 2. Rear view of the preferred embodiment of the inventive safety jacket, showing external handgrips in foreground and pocket-borne handgrips in background.

Referring now to FIG. 2, the rear of the preferred embodiment of the inventive safety jacket 200 is shown, wherein external passenger handgrips 201-203 disposed on the rear panel 204 of the inventive safety jacket. In this embodiment depicted in FIG. 2, the external passenger handgrips 201-203 are shown to each comprise two ends (205 and 206, respectively) that may be integral with structural members (described below) of the internal ribbing of the inventive jacket. Preferably, the handgrip ends may be stitched to the harness structural members through the shell of the jacket. Alternatively, the handgrips may be made integral to the inner support by welding or stitching the handgrip ends to the jacket shell or to the harness structural members directly. Handgrip ends may be inserted through slits in the jacket shell to contact the harness members and made integral thereto.

Figure 3:
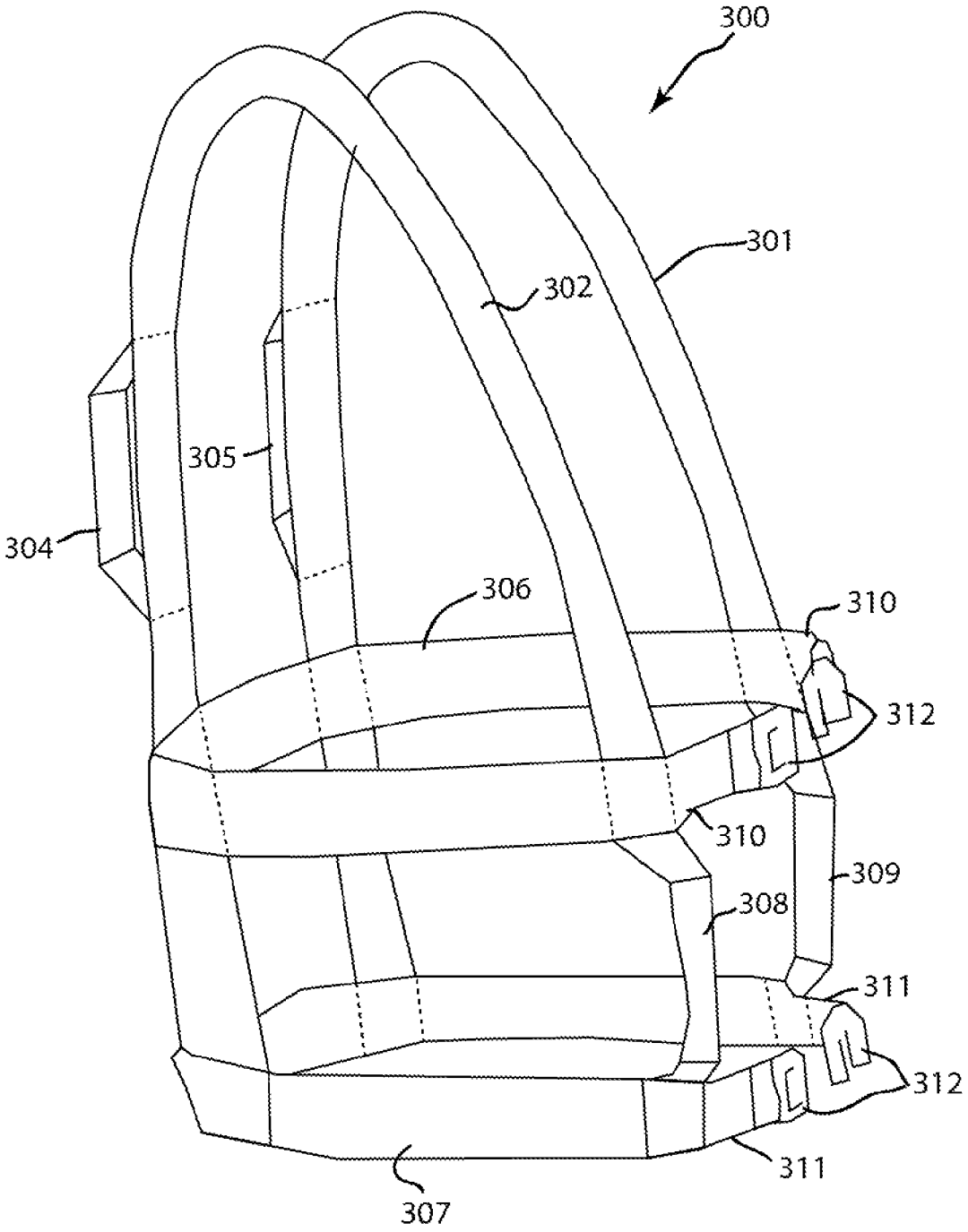
FIG. 3. Transparent view of the inventive safety jacket, showing an embodiment of the internal support frame structure from the side.

The innovative safety jacket comprises a skeleton, or an internal frame structure, disposed between the external jacket shell and an internal lining to provide reinforcement to the jacket outer shell and inner lining for carrying and distributing stresses imposed by both the external and pocket-borne handgrips, when the handgrips are engaged by a tandem passenger riding in the rear of the tandem vehicle. An example of such an internal frame is shown in FIG. 3. In the embodiment depicted, internal frame 300 comprises vertical shoulder members 301 and 302 extending from front to back, and secured to upper horizontal circumferential support member 303. In the embodiment depicted in FIG. 3, rear handgrips 304 and 305 are affixed at their ends to upper and lower horizontal circumferential support members 306 and 307, respectively. Also shown are front pocket handgrips 308 and 309 having two ends affixed to horizontal support members 306 and 307.

In the embodiment depicted in FIG. 3, the horizontal support members 306 and 307 may be fabricated from a non-elastic material or an elastic material. In the latter case of an elastic material, a rear passenger pulling on pocket handgrips 308 and 309 in the front of the jacket, or pulling on rear external handgrips 304 and 305, may apply tension on horizontal members 303 and 304 to cause these members to stretch, and in doing so, tighten against the torso of the driver. Additionally, vertical members 301 and 302 may be pulled in a downward direction against the shoulders of the driver when horizontal; members 306 and 307 are being pulled upon and stretched, providing further structural support and diffusion of tension forces away from the handgrips to the harness/torso support structure. In other embodiments, vertical members 301 and 302 may be elastic.

Safety handgrips 304, 305, 308 and 309 may be affixed to harness structural members by extending ends through the jacket shell, and may be stitched to support members 304-307. Alternatively, handgrips 304, 305, 308 and 309 may be welded to structural members 304-307 by ultrasonic welding, for example, and may also be riveted, grommeted or glued.

Moreover, the internal frame embodiment shown in FIG. 3 includes front strap pairs 310 and 311, having buckles and 312 affixed to the ends of straps 310 and 311. Strap pairs 310 and 311 serve to provide a means for the driver to prevent the front panels of the jacket from opening when the rear passenger chooses to grasp the front pocket handgrips, if the driver chooses not to close the jacket front panels by use of the front zipper or buttons.

Figure 4:
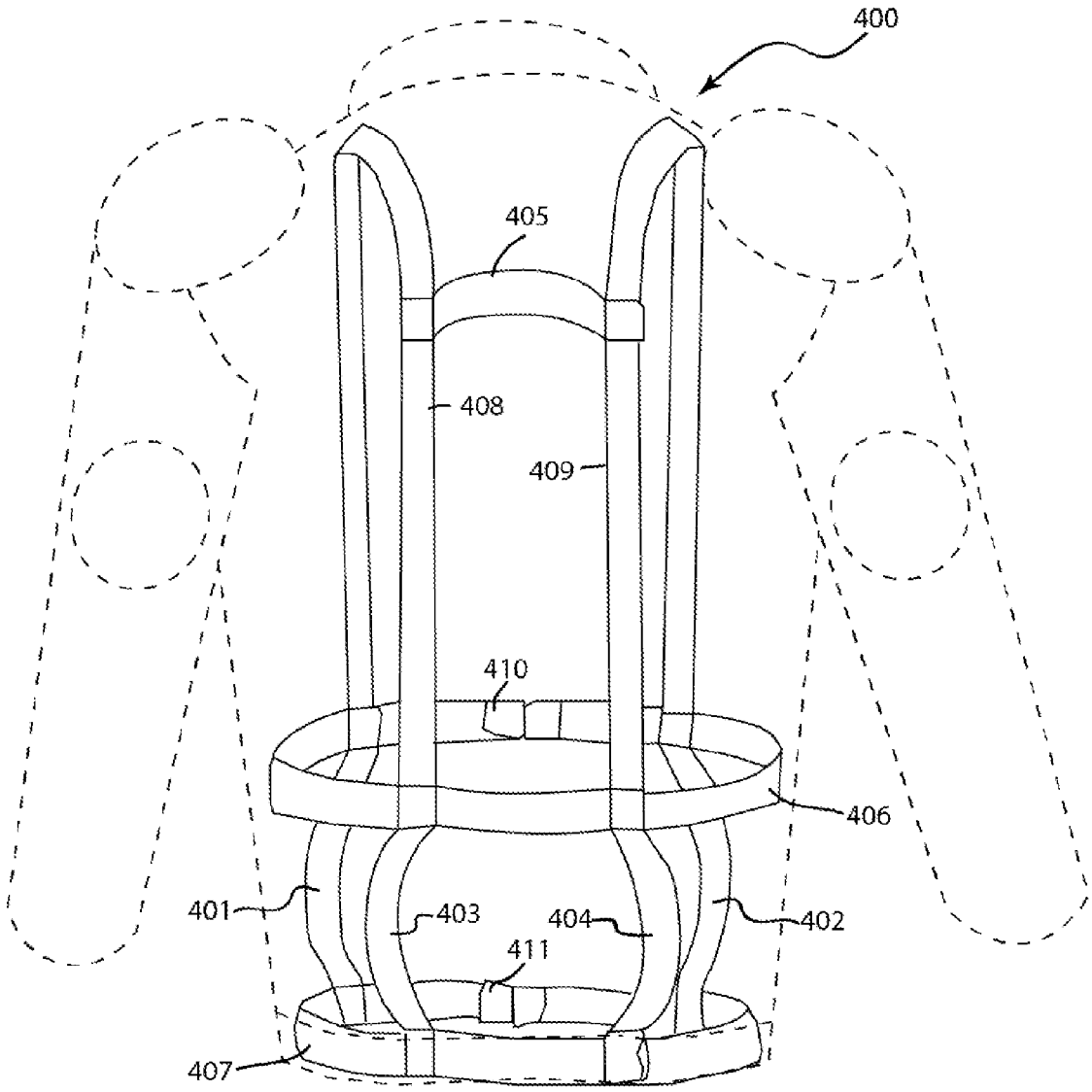
FIG. 4. Transparent view of the inventive safety jacket, showing an embodiment of the internal frame structure from rear.
Figure 5:
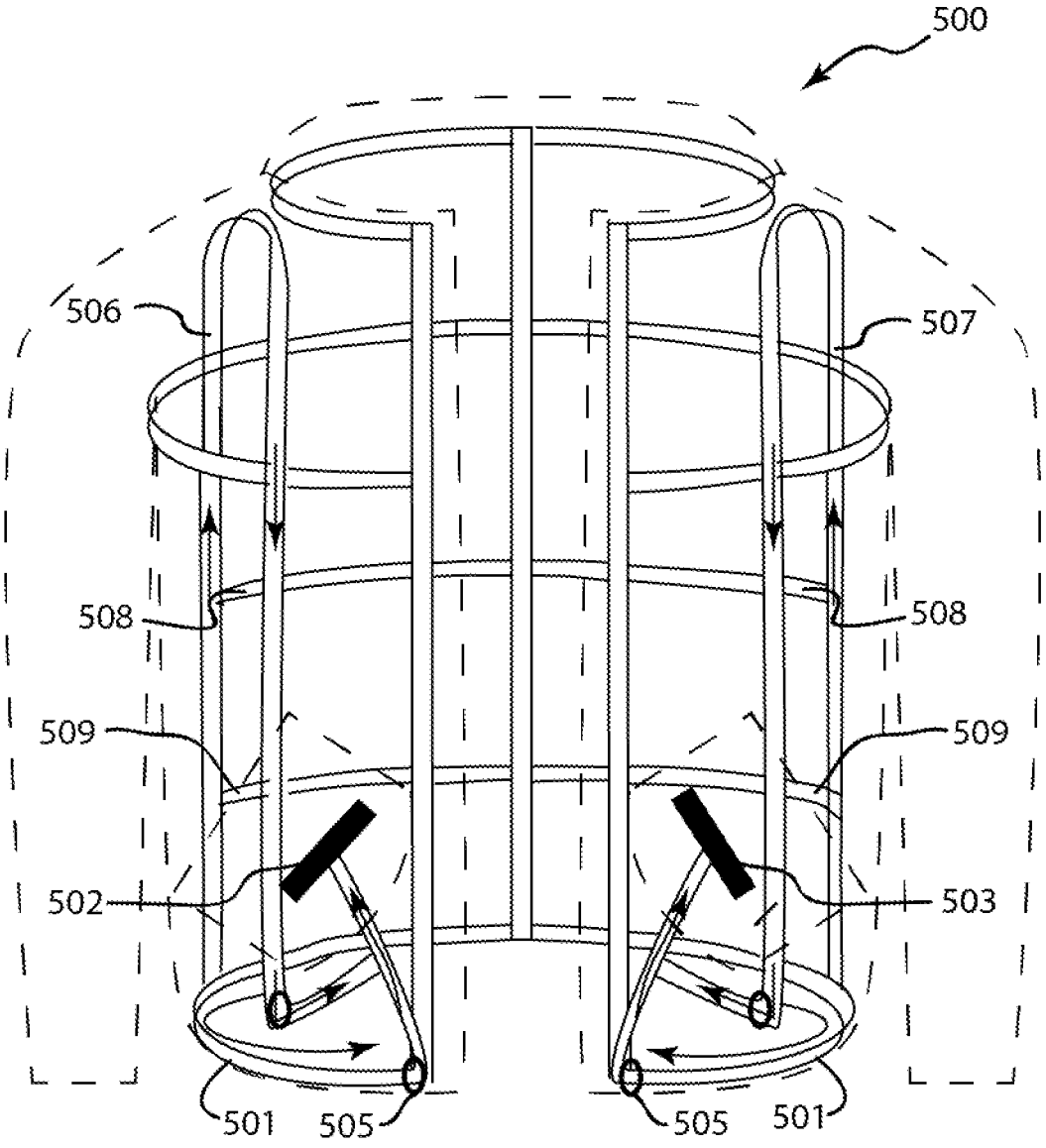
FIG. 5. Transparent view of the inventive safety jacket, showing an a second embodiment of the internal frame structure from the front, showing elastic shoulder members and waistband members connected to pocket-borne handgrips.

FIG. 4 shows a rear view of an embodiment of the internal frame structure 400 depicted in FIG. 3 inside the safety jacket shell, shown in transparency. Front pocket-borne handgrips 401 and 402, and rear handgrips 403-405, are shown having ends affixed to horizontal and vertical structural members 406-409 as in FIG. 3. As internal frame structure 400 is disposed between the shell and the internal lining of the inventive safety jacket, handgrips 401-405 may extend through holes or slits made in the jacket shell to access the internal frame structure 400. Alternatively, handgrips 401-405 may be stitched, riveted or grommeted through the jacket shell to jacket skeleton structure 400, not requiring holes or slits made through the jacket shell. An alternative embodiment of the internal frame structure of the innovative safety jacket is shown in FIG. 5, wherein the front pocket handgrips are emphasized. In this alternative embodiment, the internal frame structure 500 comprises a plurality of both elastic and non-elastic but flexible horizontal ribbing and vertical bands, henceforth referred to as shoulder members. Horizontal members may comprise one or more flexible circumferential support members extending substantially from the right zipper to the left zipper, encircling the hem or waist of the jacket. For example, a single circumferential support member 501 encircles the waist of the driver, and may be referred to as waistband member 501. An additional circumferential support member is also depicted surrounding the upper torso or chest of the tandem vehicle driver. Waistband member 501 may comprise an elastic material enabling it to stretch when tensile forces are applied. In this embodiment, waistband member 501 may terminate at both ends with front pocket handgrips 502 and 503 being affixed thereto, whereby ends of waistband member 501 may extend into the interior cavity of the front passenger safety pockets (shown in transparency) to access handgrips 502 and 503. It is also pointed out that ends of waistband member 501 may extend through rings (stationary apertures) 505. The ends (or "tether members") of the waistband member 501 are shown in FIG. 5 affixed to the handgrips 502 and 503. Rings 505 may be immovably affixed to the jacket internal frame structure 500, or to the jacket shell and/or lining. Further, vertical shoulder members 506 and 507 may be affixed at one end to waistband member 501. Moreover, vertical shoulder members may be elastic. The arrows indicate the stretch direction of the elastic members when handgrips 502 and 503 are pulled.

The other ends, as shown in FIG. 5, may extend through stationary rings 505 and terminate at handgrips 502 and 503. The portion of the elastic members 506 and 507 that extend through rings 505 may act as tethers, linking pocket-borne handgrips 502 and 503 to internal frame structure 500. Stationary rings 505 may be anchored to the outer shell or inner lining of the inventive jacket, and may also be anchored to non-elastic ribbing members of the internal frame structure. Extension of elastic support members through stationary rings 505 allows the elastic horizontal and vertical members to tighten around the torso of the driver of the tandem vehicle when the pocket-borne handgrips are pulled by the tandem vehicle passenger. It will be understood by those skilled in the art that other configurations using pocket-borne handgrips and one or more circumferential support members are possible to accomplish the same goal without departing from the scope of the invention disclosed herein.

Figure 6:
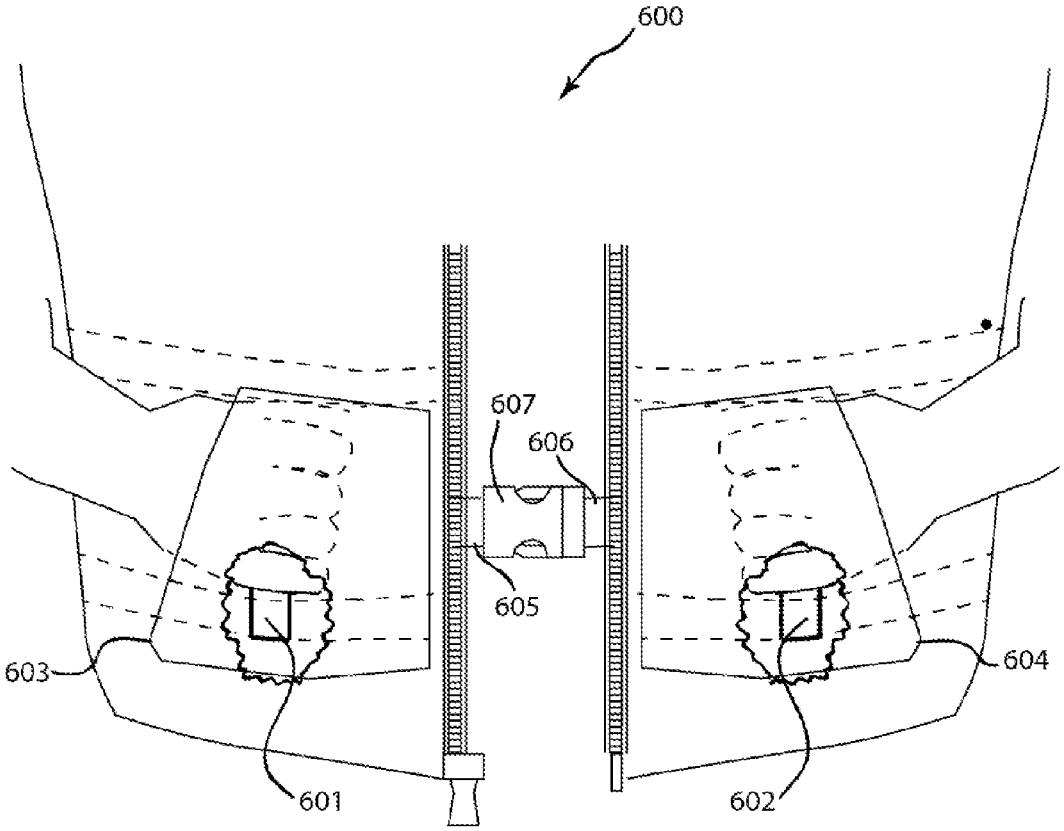
FIG. 6. View of inventive jacket features of buckle straps and engagement of pocket-borne handgrips by a tandem passenger.

In the embodiment depicted in FIG. 5, vertical shoulder members 506 and 507 may comprise an elastic material allowing these members to stretch when tensile forces are applied, such as when the tandem passenger engages the external or pocket-borne handgrips. When pulled by a rear passenger, pocket-borne handgrips 502 and 503 transmit tensile forces to both elastic waistband member 501 and vertical shoulder members 506 and 507. Tensile forces on these members may cause them to stretch, and in doing so, tighten the flexible internal frame structure against the torso of the driver. The arrows show the direction of stretch of the elastic members when tension is applied by pulling on handgrips 502 and 503. Also shown in FIG. 5 are non-elastic but flexible rib members 508 and 509 affixed to elastic vertical members 506 and 507. In concert with the elastic members of the internal frame structure, non-elastic but flexible rib members 508 and 509 may also be tightened against the driver's torso when elastic vertical shoulder members 506 and 507 are stretched by the tandem passenger pulling the pocket-borne handgrips 502 and 503. According to the invention, the act of tightening the internal frame structure against the tandem vehicle driver's torso provides reinforcement of the jacket as a tandem passenger safety device, as well as stress relief for the outer shell and the inner lining of the inventive jacket when the tandem passenger engages both the external and pocket-borne handgrips, and a means for distributing the forces applied to the jacket thereby. Again, will be understood by those skilled in the art that other configurations FIG. 6 shows an example of use of the inventive safety jacket. Rear passenger grasps pocket-borne handgrips 601 and 602 by insertion of hands in safety pockets 603 and 604. To aid in bracing the jacket for use as a tandem passenger safety device, buckle straps 605 and 606 are deployed by closing buckle 607. Buckle 607 may be used to lock the front jacket front panels together when it is desired not to close the jacket by traditional means such as the front zipper or by buttons, so that the innovative safety features of the inventive jacket may be advantageously available for use by the rear passenger. Buckle straps 605 and 606 also may provide strain relief for the front zipper when the pocket-borne handgrips are engaged.

The embodiments of the inventive tandem vehicle passenger safety jacket described herein serve as examples for the purposes of this disclosure, and are by no means meant to be construed as limiting the invention to those specified. It is to be understood by persons having skill in the art that many equivalent permutations of the described embodiments may be conceived without departing from the scope and spirit of the invention.

The invention claimed is:

1. A tandem vehicle passenger safety jacket garment for providing safety and comfort to a tandem passenger seated behind the driver of the two-seat vehicle, comprising:

(i) an outer shell and an interior lining, said outer shell and interior lining having an intervening space, said outer shell having a right front panel, a left front panel, a rear panel and a hem, wherein at least one external handgrip is disposed on the rear panel;

(ii) a frame structure disposed in the intervening space between the outer shell and interior lining, said frame skeleton comprising a ribbing nexus having a plurality of intersecting elongate members, whereby two or more substantially horizontal elongate members intersect two or more substantially vertical elongate members, each horizontal elongate member bonded to one or more intersecting vertical elongate members at the point of intersection;

(iii) at least one front jacket pocket disposed substantially on the lower portion of the each of the two front panels of the outer shell of the safety jacket garment, said front jacket pockets having an interior cavity and an opening; and (iv) a pocket-borne handgrip disposed within the interior cavity of the at least one of the front jacket pockets disposed on each of the two front panels of the outer shell of the safety jacket garment, said handgrip mechanically linked to the frame structure by a tether member having a first end affixed to the pocket-borne handgrip, and a second end affixed to at least one of the elongate members of the frame structure.

2. The tandem vehicle passenger safety jacket garment of claim 1, wherein the two or more substantially horizontal members comprises an elastic waistband member, said elastic waistband member extending around the bottom portion of the jacket garment from the left front panel to the right front panel of the jacket garment.

3. The tandem vehicle passenger safety jacket garment of claim 1, wherein the two or more substantially horizontal members comprises two or more elastic waistbands, each of the two or more elastic waistbands extending around the bottom portion of the jacket garment from the left front panel to the right front panel of the jacket garment, each of the two or more waistband members, the two or more waistband members being displaced vertically relative to one another.

4. The tandem vehicle passenger safety jacket garment of claim 1, wherein the pocket-borne handgrip disposed within the interior cavity of the at least one of the front pockets disposed on each of the two front panels of the outer shell of the safety jacket garment comprises a strap having two ends, each strap end being affixed to one of the two or more substantially horizontal elongate members.

5. The tandem vehicle passenger safety jacket garment of claim 1, wherein at least one of the two or more substantially horizontal elongate members comprises an elastic material.

6. The tandem vehicle passenger safety jacket garment of claim 1, wherein at least one of the two or more substantially vertical elongate members comprises an elastic material.

7. The tandem vehicle passenger safety jacket garment of claim 1, wherein at least one of the two or more substantially horizontal elongate members comprises a non-elastic material.

8. The tandem vehicle passenger safety jacket garment of claim 1, wherein at least one of the two or more substantially vertical elongate members comprises a non-elastic material.

9. The tandem vehicle passenger safety jacket garment of claim 1, further comprising at least one substantially stationary aperture through which the tether member extends.

10. The tandem vehicle passenger safety jacket garment of claim 9, wherein the stationary aperture is affixed to the outer shell.

11. The tandem vehicle passenger safety jacket garment of claim 9, wherein the at least one stationary aperture is affixed to the inner lining.

12. The tandem vehicle passenger safety jacket garment of claim 9, wherein the at least one stationary aperture is affixed to at least one ribbing nexus member.

13. The tandem vehicle passenger safety jacket garment of claim 9, wherein the at least one stationary aperture is a ring.

14. A tandem vehicle passenger safety jacket garment for providing safety and comfort to a tandem passenger seated behind the driver of the two-seat vehicle, comprising:

(i) an outer shell and an interior lining, said outer shell and interior lining having an intervening space, said outer shell having a right front panel, a left front panel, a rear panel and a hem, wherein at least one external handgrip is disposed on the rear panel;

(ii) a frame skeleton disposed in the intervening space between the outer shell and interior lining, said frame skeleton comprising a ribbing nexus having a plurality of intersecting elongate members, whereby two or more substantially horizontal elongate members intersect two or more substantially vertical elongate members, each horizontal elongate member bonded to one or more intersecting vertical elongate members at the point of intersection;

(iii) at least one front jacket pocket disposed substantially on the lower portion of the each of the two front panels of the outer shell of the safety jacket garment, said front jacket pockets having an interior cavity and an opening;

(iv) a pocket-borne handgrip disposed within the interior cavity of the at least one of the exterior jacket pockets disposed on each of the two front panels of the outer shell of the safety jacket garment, said handgrip mechanically linked to the frame skeleton by a tether member having a first end affixed to the pocket-borne handgrip, and a second end affixed to at least one of the elongate members of the frame skeleton; and (v) at least one substantially stationary aperture, through which the tether member extends.

15. The tandem vehicle passenger safety jacket garment of claim 14, wherein the stationary aperture is affixed to the outer shell.

16. The tandem vehicle passenger safety jacket garment of claim 14, wherein the at least one stationary aperture is affixed to the inner lining.

17. The tandem vehicle passenger safety jacket garment of claim 14, wherein the at least one stationary aperture is affixed to at least one ribbing nexus member.

18. The tandem vehicle passenger safety jacket garment of claim 14, wherein the at least one stationary aperture is a ring.

* * * * *